US009632463B2

(12) United States Patent
Yagi et al.

(10) Patent No.: US 9,632,463 B2
(45) Date of Patent: Apr. 25, 2017

(54) IMAGE FORMING APPARATUS

(71) Applicant: KABUSHIKI KAISHA TOSHIBA, Minato-ku (JP)

(72) Inventors: Ryosuke Yagi, Yokohama (JP); Takuya Hongo, Yokohama (JP); Norihiro Tomimatsu, Mitaka (JP)

(73) Assignee: KABUSHIKI KAISHA TOSHIBA, Minato-ku (JP)

( * ) Notice: Subject to any disclaimer, the term of this patent is extended or adjusted under 35 U.S.C. 154(b) by 0 days.

(21) Appl. No.: 14/984,653

(22) Filed: Dec. 30, 2015

(65) Prior Publication Data

US 2016/0216664 A1 Jul. 28, 2016

(30) Foreign Application Priority Data

Jan. 28, 2015 (JP) ..... 2015-014476

(51) Int. Cl.
*G03G 15/20* (2006.01)

(52) U.S. Cl.
CPC ..... *G03G 15/2039* (2013.01); *G03G 15/2017* (2013.01); *G03G 15/2082* (2013.01); *G03G 15/2064* (2013.01)

(58) Field of Classification Search
CPC ..... G03G 15/2039; G03G 15/2042; G03G 15/2046; G03G 15/2078; G03G 15/2082
See application file for complete search history.

(56) References Cited

U.S. PATENT DOCUMENTS 4,512,650 A * 4/1985 Kocher ..... G03G 15/2025 118/259
5,785,885 A * 7/1998 Kakiuchi ..... C09K 5/066 252/70
6,148,163 A * 11/2000 Ito ..... G03G 15/2064 399/299
6,445,902 B1 * 9/2002 Hirst ..... G03G 15/2064 219/216
8,041,279 B2 * 10/2011 Kladias ..... G03G 15/2042 399/328

(Continued)

FOREIGN PATENT DOCUMENTS

JP 2633006 7/1997
JP 2006-227487 8/2006

(Continued)

*Primary Examiner* — David M Gray
*Assistant Examiner* — Carla Therrien
(74) *Attorney, Agent, or Firm* — Oblon, McClelland, Maier & Neustadt, L.L.P.

(57) ABSTRACT

An image forming apparatus according to an embodiment includes, a fixing roller including a heat generation source, supplying heat to a printing object, and fixing toner on the printing object, an opposing roller opposed to the fixing roller to hold the printing object between the opposing roller and the fixing roller, a heat exchange roller containing a heat storage material capable of changing in between a liquid and a solid phase, a sensor capable of sensing a temperature of the fixing roller; and a driving unit causing the heat exchange roller to abut against the fixing roller and separating the heat exchange roller from the fixing roller, in accordance with the temperature of the fixing roller sensed by the sensor.

3 Claims, 7 Drawing Sheets

(56) References Cited

U.S. PATENT DOCUMENTS

| | | | | |
|---|---|---|---|---|
| 8,165,487 | B2 * | 4/2012 | Kanou | G03G 15/2039 399/69 |
| 8,238,770 | B2 * | 8/2012 | Shimizu | G03G 15/2042 399/33 |
| 2005/0089343 | A1 * | 4/2005 | Mathers | G03G 15/205 399/69 |
| 2006/0177250 | A1 * | 8/2006 | Nakagaki | G03G 15/2064 399/328 |
| 2006/0291919 | A1 * | 12/2006 | Domoto | G03G 15/2017 399/328 |
| 2010/0150625 | A1 | 6/2010 | Sone et al. | |
| 2012/0051813 | A1 * | 3/2012 | Furuyama | G03G 15/6573 399/341 |
| 2013/0058673 | A1 * | 3/2013 | Kikkawa | G03G 15/206 399/69 |
| 2013/0188978 | A1 * | 7/2013 | Takeuchi | G03G 15/2042 399/69 |

FOREIGN PATENT DOCUMENTS

| | | |
|---|---|---|
| JP | 2008-139665 | 6/2008 |
| JP | 2010-146001 | 7/2010 |
| JP | 2012-82037 | 4/2012 |
| JP | 2014-102397 | 6/2014 |

* cited by examiner

IMAGE FORMING APPARATUS

CROSS-REFERENCE TO RELATED APPLICATIONS

This application is based upon and claims the benefit of priority from prior Japanese Patent Application No. 2015-014476, filed Jan. 28, 2015, the entire contents of which are incorporated herein by reference.

FIELD

Embodiments described herein relate generally to an image forming apparatus capable of forming an image on a printing object.

BACKGROUND

An image forming apparatus that forms a toner image on a printing object (paper) is disclosed. The image forming apparatus has a structure in which a toner image is formed in a transfer unit, the toner image is transferred onto a printing object supplied from a paper feeding unit to the transfer unit, and the toner image is fixed on the printing object in a fixing unit. The fixing unit includes a heating roller including a heat source, and a pressure roller that is opposed to the heating roller and applies pressure to the printing object. The fixing unit holds a printing object between the rollers and applies heat and pressure thereto to melt the toner and fix the image on the printing object.

Generally, the width of the heating roller is larger than the width of the printing object. For this reason, the heating roller includes a contact region that contacts the printing object and is located close to the center, and non-contact regions that do not contact the printing object and are located outside.

Another image forming apparatus has a structure in which a roller filled with a latent heat storage material is disposed at an outlet of the fixing unit, and the roller absorbs heat of the printing object to make the temperature of the printing object uniform.

DETAILED DESCRIPTION

An image forming apparatus according to an embodiment includes: a fixing roller including a heat generation source, supplying heat to a printing object, and fixing toner on the printing object; an opposing roller opposed to the fixing roller to hold the printing object between the opposing roller and the fixing roller; a heat exchange roller containing a heat storage material capable of changing in between a liquid and a solid phase; a sensor capable of sensing a temperature of the fixing roller; and a driving unit causing the heat exchange roller to abut against the fixing roller and separating the heat exchange roller from the fixing roller, in accordance with the temperature of the fixing roller sensed by the sensor.

[First Embodiment]

A first embodiment of an image forming apparatus will be explained hereinafter with reference to FIG. 1. The image forming apparatus is a concept including various types of printing apparatuses such as copying machines, printers, facsimile machines, and multifunction machines that include these functions, which form a toner image on a printing object.

Figure 1:
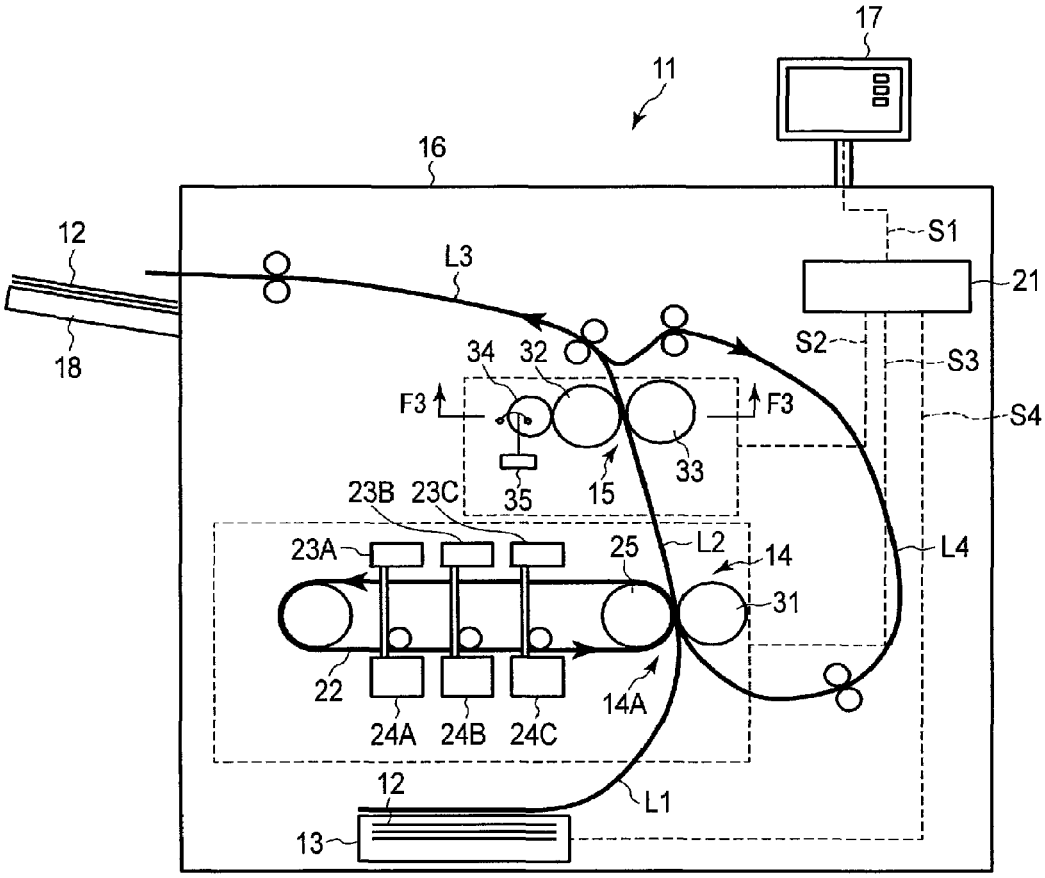
FIG. 1 is a schematic diagram illustrating an overall configuration of an image forming apparatus according to a first embodiment.

As illustrated in FIG. 1, an image forming apparatus 11 includes a paper feeding unit 13 (paper feed tray) that stores printing objects 12, a transfer unit 14 that forms a toner image on a printing object 12, a fixing unit 15 that thermally fixes the toner image on the printing object 12, a first conveyance line L1, a second conveyance line L2, and a third conveyance line L3 that are arranged in series, a return conveyance line L4 that is looped to return the printing object 12 from a boundary between the second conveyance line L2 and the third conveyance line L3 to a boundary between the first conveyance line L1 and the second conveyance line L2, a housing 16 that contains the above elements, a paper delivery unit 18 (paper delivery tray) located outside the housing 16, to which the printing object 12 on which the image is printed is delivered, and an operating unit 17 disposed on an upper surface of the housing 16 and the like.

The user can perform input operations using the operating unit 17. In this manner, a controller 21 controls the image forming apparatus 11 to perform processing such as printing of a desired image. The paper feeding unit 13 includes a paper feed mechanism formed of rollers and the like. The paper feed mechanism is capable of feeding each paper feed object 12 toward the first conveyance line L1.

The transfer unit 14 includes a transfer belt 22, a plurality of toner boxes 23, and a plurality of image forming units 24 provided to correspond one-on-one to the toner boxes 23. The transfer belt 22 is formed of a flexible material, such as a polyimide film, in an annular shape. The transfer belt 22 is rotated counterclockwise, for example, in FIG. 1 to carry a toner image formed by the image forming units 24 toward a transfer roller 25.

The toner boxes 23 are provided for color printing, for example. The toner boxes 23 include a yellow toner box 23A, a black toner box 23B, and a magenta toner box 23C. Each of the toner boxes 23 contains toner of the corresponding color. The toner contained in the respective toner boxes is supplied to the corresponding image forming units 24 (24A, 24B, and 24C). When the image forming apparatus 11 is configured as a dedicated machine for monochrome printing, only the toner box that contains black toner may be used.

Each of the image forming units 24 (24A, 24B, and 24C) includes a photosensitive drum and a developing device. Each of the image forming units 24 (24A, 24B, and 24C) is capable of forming a toner image by developing an electrostatic latent image formed on a circumferential surface of its photosensitive drum by the developing device that discharges toner thereto.

The transfer unit 14 includes the transfer roller 25 and a transfer opposing roller 31 that are arranged on the downstream side of the image forming units 24. The transfer roller 25 is located inside the transfer belt 22, and contacts the internal surface of the transfer belt 22. The transfer opposing roller 31 is opposed to the transfer roller 25, and forms a roller pair together with the transfer roller 25. The transfer opposing roller 31 is located in contact with the external surface of the transfer belt 22 so that the transfer opposing roller 31 is opposed to the transfer roller 25 with the transfer belt 22 held between the transfer opposing roller 31 and the transfer roller 25. The transfer roller 25 transfers a toner image formed on the transfer belt 22 onto a printing object 12 passing between the transfer roller 25 and the transfer opposing roller 31.

Figure 2:
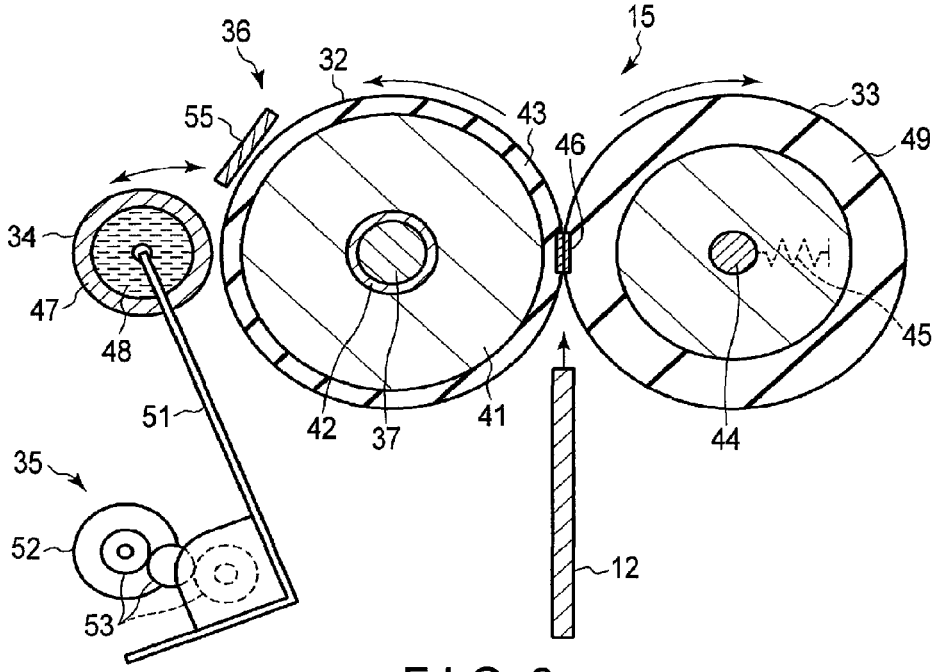
FIG. 2 is an enlarged cross-sectional view of a fixing unit of the image forming apparatus illustrated in FIG. 1.

The fixing unit 15 applies heat to the-printing object 12 to thermally fix the toner image transferred onto the printing object 12 on the printing object 12. As illustrated in FIG. 2, the fixing unit 15 includes a fixing roller 32 (heating roller), a fixing opposing roller 33, a heat exchange roller 34 (heat absorption roller), a driving unit 35, and a sensor 36.

Figure 3:
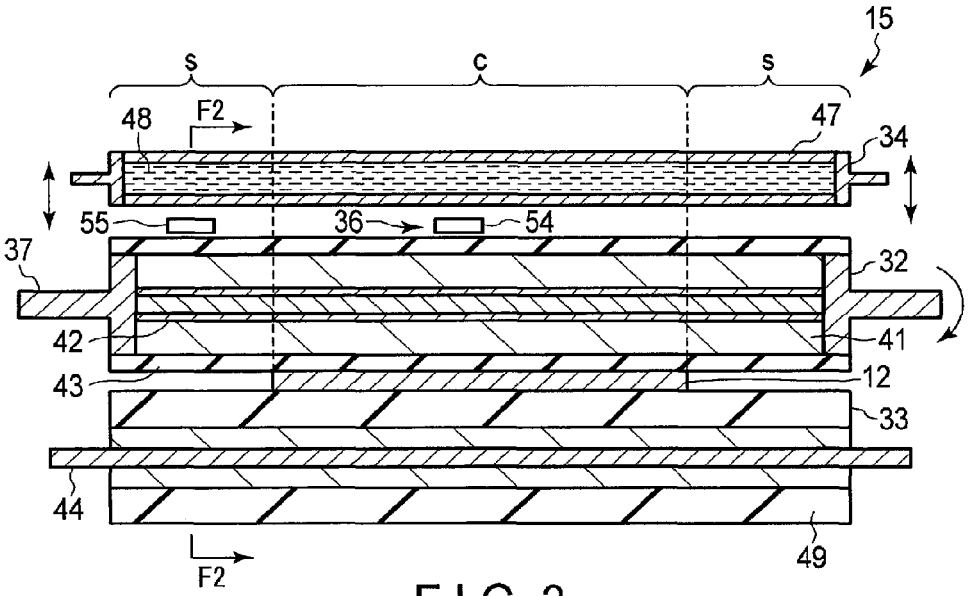
FIG. 3 is a cross-sectional view taken along line F3-F3 in the image forming apparatus illustrated in FIG. 1.

As illustrated in FIG. 2 and FIG. 3, the fixing roller 32 includes a roller main body 41 that is rotatable around a shaft portion 37, and a heater 42 provided in the roller main body 41 and serving as a heat generation source that generates heat by being supplied with power. The heater 42 is formed of, for example, a halogen lamp or an IH heater that performs heating by electromagnetic induction, included in the center portion of the roller main body 41. A surface of the fixing roller 32 may be provided with a rubber layer 43 such as silicon rubber and fluororubber.

The fixing roller 32 includes a contact region C that is provided in the center and contacts the printing object 12 in printing, and non-contact regions S that are provided at end portions and do not contact the printing object 12 in printing.

The fixing opposing roller 33 is opposed to the fixing roller 32 and disposed in contact with the fixing roller 32. The fixing opposing roller 33 includes a rotating shaft portion 44, a foamed rubber layer 49 provided outside (surface layer side) the rotating shaft portion 44, and a pressure mechanism 45 that presses the rotating shaft portion 44 and the foamed rubber layer 49 against the fixing roller 32. The pressure mechanism 45 includes a drive motor. The drive motor moves the rotating shaft portion 44 forward and backward to regulate the amount of pressing of the rotating shaft portion 44 and the foamed rubber layer 49 against the fixing roller 32, and to regulate a nip width 46 formed between the fixing roller 32 and the fixing opposing roller 33.

As illustrated in FIG. 2 and FIG. 3, the heat exchange roller 34 includes a metal cylindrical portion 47 formed of aluminum alloy or the like, and a heat storage material 48 (phase change material) that is contained inside the cylindrical portion 47 and absorbs heat using a phase change (latent heat) between solid and liquid. The heat storage material 48 has a phase change temperature in a temperature range from 100° C. or more and 150° C. or less. The heat storage material 48 changes in phase from solid to liquid when it is heated to a temperature higher than the phase change temperature. By contrast, the heat storage material 48 changes in phase from liquid to solid when it is cooled to a temperature lower than the phase change temperature. Specifically, the heat storage material 48 is formed of a polymer material of erythritol or mannitol, but may be another heat storage material (phase change material) as long as the material has a phase change temperature in a similar temperature range. The phase change temperature of erythritol is 115 to 120° C., and the phase change temperature of mannitol is 140 to 150° C. By contrast, the melting point of the toner is, for example, 70 to 90° C. This structure prevents a decrease in the temperature of the fixing roller 32 to a temperature lower than the melting point of the toner, even when the heat exchange roller 34 abuts against the fixing roller 32.

The driving unit 35 rotatably supports the heat exchange roller 34, and is capable of causing the heat exchange roller 34 to abut against the fixing roller 32, or of separating the heat exchange roller 34 from the fixing roller 32. The driving unit 35 includes an arm part 51 that supports the heat exchange roller 34 and is rotatable around the fulcrum, a motor 52 serving as a driving source when the arm part 51 is rotated around the fulcrum, and a plurality of gears 53 that transmit the torque of the motor 52 to the arm part 51.

As illustrated in FIG. 3, the sensor 36 includes a first sensing unit 54 provided to correspond to the contact region C in the fixing roller 32, and a second sensing unit 55 provided to correspond to the non-contact region S. The first sensing unit 54 is capable of sensing a first temperature Tc serving as a temperature of the contact region C (center portion) of the fixing roller 32. The second sensing unit 55 is capable of sensing a second temperature Ts serving as a temperature of the non-contact region S (end portion) of the fixing roller 32. The first sensing unit 54 and the second sensing unit 55 may be, for example, thermocouples that directly contact the fixing roller 32 to measure a temperature thereof, resistance change thermistors of a non-contact type, or radiation temperature sensors, or may be temperature sensors of other types.

A plurality of first sensing units 54 may be provided in a line along a direction in which the fixing roller 32 extends. In such a case, an average value of temperature information obtained from the first sensing units 54 may be adopted as the first temperature Tc of the contact region C. In the same manner, a plurality of sensing units 55 may be provided in a line along the direction in which the fixing roller 32 extends. In such a case, an average value of temperature information obtained from the second sensing units 55 may be adopted as the second temperature Ts of the non-contact region S. The image forming apparatus 11 may include a sensor that is capable of sensing the size of the printing object 12 in the middle of the first conveyance line L1. When the size of the printing object 12 changes for each printing, the controller 21 may use some of the first sensing units 54 as the second sensing units 55, based on a detection result of the size of the printing object 12 by the sensor. By contrast, the controller 21 may use some of the second sensing units 55 as the first sensing units 54, based on the detection result of the size of the printing object 12.

As illustrated in FIG. 1, each one of the first conveyance line L1 to the fourth conveyance line L4 includes a conveyance path, and a plurality of roller pairs and belt pairs to hold the printing object 12 (including a printed item subjected to printing) therebetween and to convey the printing object 12 along the conveyance path.

The first conveyance line L1 is provided to extend from the paper feeding unit 13 to the transfer unit 14 (secondary transfer unit 14A). The printing object 12 in the paper feeding unit 13 is conveyed to the transfer unit 14 by the first conveyance line L1. The second conveyance line L2 is provided to extend from the transfer unit 14 to the fixing unit 15. The printing object 12 that has passed through the transfer unit 14 is conveyed to fixing unit 15 by the second conveyance line L2. The third conveyance line L3 is provided to extend from the fixing unit 15 to the paper delivery unit 18. The printing object 12 that has passed through the fixing unit 15 is conveyed to the paper delivery unit 18 by the third conveyance line L3. The return conveyance line L4 is used when the printing object 12 that has passed through the fixing unit 15 is to be returned to the transfer unit 14, in the case where images are formed on both sides of the printing object 12.

Figure 4:
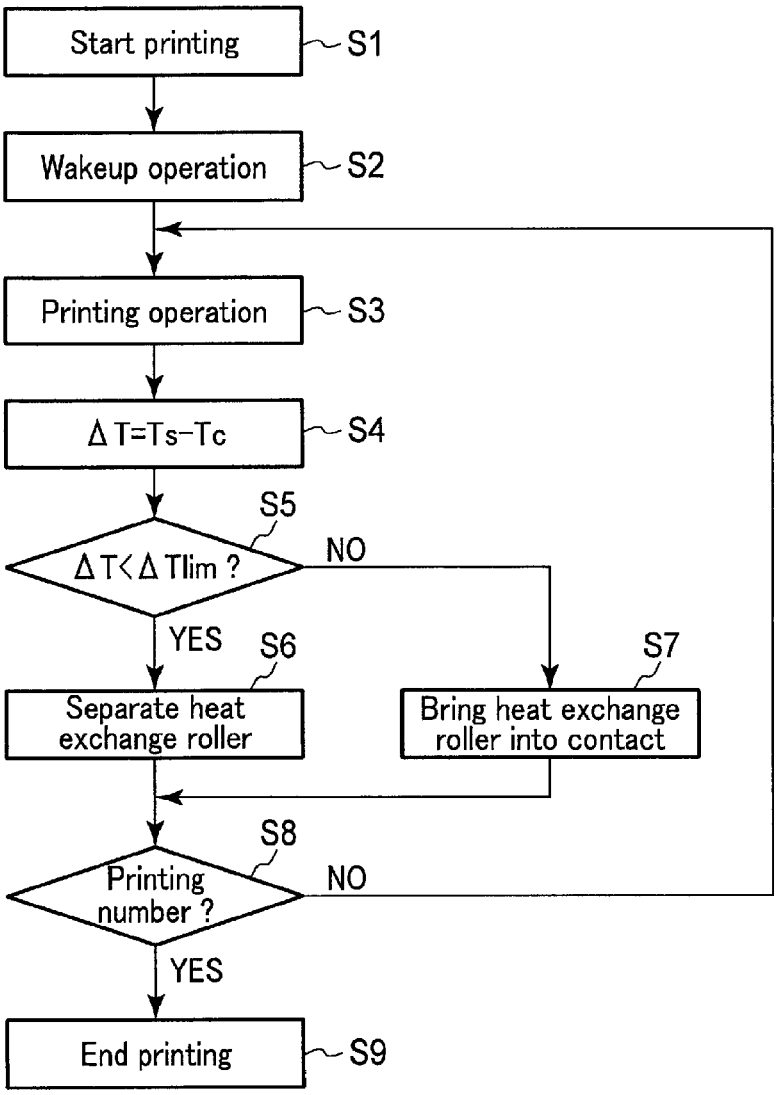
FIG. 4 is a flowchart illustrating an image forming method using the image forming apparatus according to the first embodiment.

The following is an explanation of an image forming method using the image forming apparatus 11, with reference to FIG. 4 and the like. By a user's operation of the operating unit 17, the controller 21 of the image forming apparatus 11 receives a printing start instruction through line S1 (Step S1). In accordance with the instruction, the controller 21 executes a wakeup operation (Step S2). By the operation, the controller 21 supplies a temperature control instruction to the fixing unit 15, supplies power to the heater 42 of the fixing roller 32 to heat the fixing roller 32 and the fixing opposing roller 33 contacting the roller to a predetermined temperature, that is, a temperature necessary for fixing the toner.

After the fixing unit 15 is heated to a suitable temperature in this manner, the controller 21 drives the transfer unit 14 through line S3 to start a printing operation (Step S3). In this manner, the transfer belt 22 of the transfer unit 14 is rotated counterclockwise in FIG. 1 to form a toner image on a surface of the transfer belt 22. The toner image is conveyed to the vicinity of the transfer roller 25 with rotation of the transfer belt 22. By contrast, the controller 21 operates the paper feed mechanism provided in the paper feeding unit 13 through line S4, to feed the printing object 12 from the paper feeding unit 13 to the first conveyance line L1, and convey the printing object 12 to the transfer unit 14 by the first conveyance line L1.

The controller 21 causes the printing object 12 to reach the second transfer unit 14A in synch with the timing at which the toner image reaches the second transfer unit 14A, to transfer the toner image from the transfer belt 22 to one surface (surface contacting the transfer belt 22) of the printing object 12 with the transfer roller 25 and the transfer opposing roller 31.

The printing object 12 that has passed the second transfer unit 14A is conveyed to the fixing unit 15 by the second conveyance line L2. The printing object 12 and the toner of the toner image transferred thereon are heated at the fixing roller 32, and the toner image is fixed on the printing object 12. The printing operation is continued until the number of printed items reaches the printing number designated by the user. During the printing operation, the first sensing unit 54 of the sensor 36 senses the first temperature Tc of the contact region C of the fixing roller 32, and the second sensing unit 55 senses the second temperature Ts of the non-contact region S of the fixing roller 32 (Step S4). Thereafter, the value of the difference "ΔT=Ts−Tc" between the second temperature Ts and the first temperature Tc is compared with a predetermined upper limit temperature difference value ΔTlim (Step S5). When ΔT is smaller than ΔTlim, the controller 21 operates the driving unit 35 to separate the heat exchange roller 34 from the fixing roller 32 (Step S6). The temperature difference value ΔTlim is, for example, properly set within a range of 30 to 100° C. This structure prevents an excessive decrease in the temperature of the fixing roller 32. By contrast, when AT exceeds ΔTlim, the controller 21 operates the driving unit 35 to make the heat exchange roller 34 abut against the fixing roller 32 (Step 57). The abutting enables absorption of heat of the fixing roller 32 into the heat exchange roller 34 by latent heat melting of the heat storage material 48 (phase change material) included in the heat exchange roller 34, and a decrease in the temperature of the fixing roller 32. Also in this case, the melting point of the heat storage material 48 in the heat exchange roller 34 falls within a range higher than 100° C. and lower than 150° C., to prevent a decrease in the temperature of the fixing roller 32 to a temperature equal to or lower than the melting point (70 to 90° C.) of the toner even when the heat exchange roller 34 is made to abut against the fixing roller 32.

The separating and abutting operations in accordance with the temperature difference ΔT are repeated until the number of printed items reaches a set printing number (Step S8). When the number of printed items reaches the set printing number, the printing operation is ended (Step S9). The above image forming method enables the fixing roller 32 to have both a uniform temperature and power savings.

According to the first embodiment, the image forming apparatus 11 includes a fixing roller 32 that includes a heat generation source and which applies heat to the printing object 12 to fix toner on the printing object 12, an opposing roller that is opposed to the fixing roller 32 to hold the printing object 12 between the opposing roller and the fixing roller 32, a heat exchange roller 34 that contains the heat storage material 48 capable of changing in phase between liquid and solid, the sensor 36 capable of sensing the temperature of the fixing roller 32, and the driving unit 35 which causes the heat exchange roller 34 to abut against the fixing roller 32 and separates the heat exchange roller 34 from the fixing roller 32, in accordance with the temperature of the fixing roller 32 sensed by the sensor 36.

Generally, when a printing operation is continued, radiation of heat from the fixing roller 32 is successively performed through the printing object 12 in the contact region C that contacts the printing object 12 in the fixing roller 32, while no heat is radiated but heat is accumulated in the non-contact regions S that do not contact the printing object 12. For this reason, the fixing roller temperature Ts increases in the non-contact region S, and the heat may damage a peripheral member (such as the opposing roller) that contacts the non-contact regions S of the fixing roller 32. In addition, when a large-sized printing object 12 extending over both the contact region C and the non-contact region S is supplied in a state where the temperature of the non-contact region S is increased, toner on the printing object 12 may stick to the fixing roller 32, and thereby the printing quality may deteriorate.

With the above structure, for example, when the temperature of the fixing roller 32 increases, the heat exchange roller 34 is made to abut against the fixing roller 32 to absorb the temperature of the fixing roller 32 by the heat exchange roller 34. By contrast, when the temperature of the fixing roller 32 becomes lower than the predetermined temperature, the heat exchange roller 34 is made to abut against the fixing roller 32 to supply the heat accumulated in the heat exchange roller 34 to the fixing roller 32 (see the second embodiment). In this manner, extra heat generated in the fixing roller 32 is accumulated in the heat exchange roller 34, and the heat accumulated in the heat exchange roller 34 can be returned to the fixing roller 32 if necessary, such as in the case where the temperature of the fixing roller 32 decreases (for example, printing is resumed after a predetermined time has passed). The above structure prevents damage to the peripheral member due to heat, prevents toner from sticking to the fixing roller 32, and enables improvement in the printing quality. In addition, the above structure reduces the power necessary for heating the fixing roller 32 when printing is resumed, and promotes power savings in the image forming apparatus 11.

The image forming apparatus 11 includes the controller 21 that controls the driving unit 35. The sensor 36 includes the first sensing unit 54 that senses the temperature of the center portion of the fixing roller 32, and the second sensing unit 55 that senses the temperature of the end portion of the fixing roller 32. The controller 21 controls the driving unit 35 to make the heat exchange roller 34 abut against the fixing roller 32 when the temperature difference between the first temperature Tc sensed by the first sensing unit 54 and the second temperature Ts sensed by the second sensing unit 55 is larger than a predetermined value.

Generally, when the temperature difference ΔT between the first temperature Tc of the contact region C and the temperature Ts of the non-contact region S is small, temperature unevenness is solved with the passage of time by heat diffusion in the fixing roller 32. However, when control is executed to abut the heat exchange roller 34 against the fixing roller 32 in the case where the temperature difference ΔT between the first temperature Tc of the contact region C and the second temperature Ts of the non-contact region S of the fixing roller 32 is small, the temperature of the fixing roller 32 is decreased, and the power consumption may increase even more to reheat the fixing roller 32.

The above structure enables control to bring the heat exchange roller 34 into contact with the fixing roller 32 when the temperature difference between the first temperature Tc and the second temperature Ts is larger than a predetermined temperature. Due to this, for example, when the temperature becomes too high in the non-contact region S, the heat of the fixing roller 32 can be absorbed by the heat exchange roller 34 to prevent an excessive decrease in the temperature of the fixing roller 32. This structure further facilitates power savings in the image forming apparatus 11.

In this case, the phase change temperature of the heat storage material 48 is higher than the melting point of the toner.

Normally, the heat storage material 48 that is capable of changing between the liquid and solid phase has a property of maintaining a fixed temperature during the phase change. The above structure prevents the temperature of the fixing roller 32 from decreasing to a temperature equal to or lower than the melting point of the toner, even when the heat exchange roller 34 is made to abut against the fixing roller 32. This structure prevents a defect of a reduction in printing quality in which the toner is not sufficiently molten and is not fixed to the printing object 12.

[Second Embodiment]

Figure 5:
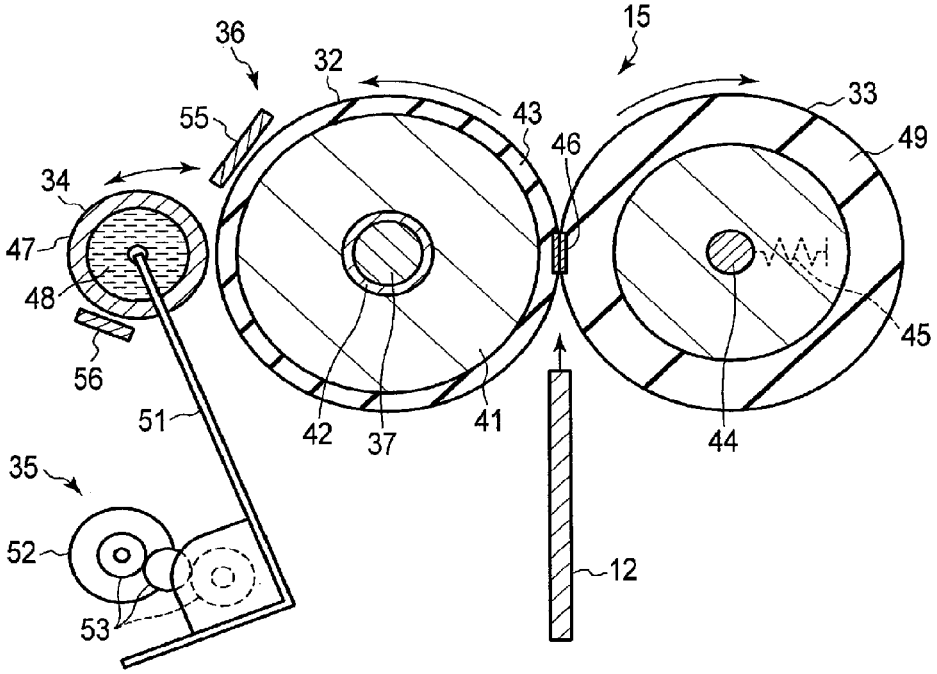
FIG. 5 is an enlarged cross-sectional view of a fixing unit of an image forming apparatus according to a second embodiment, taken along line F5-F5 illustrated in FIG. 6.
Figure 6:
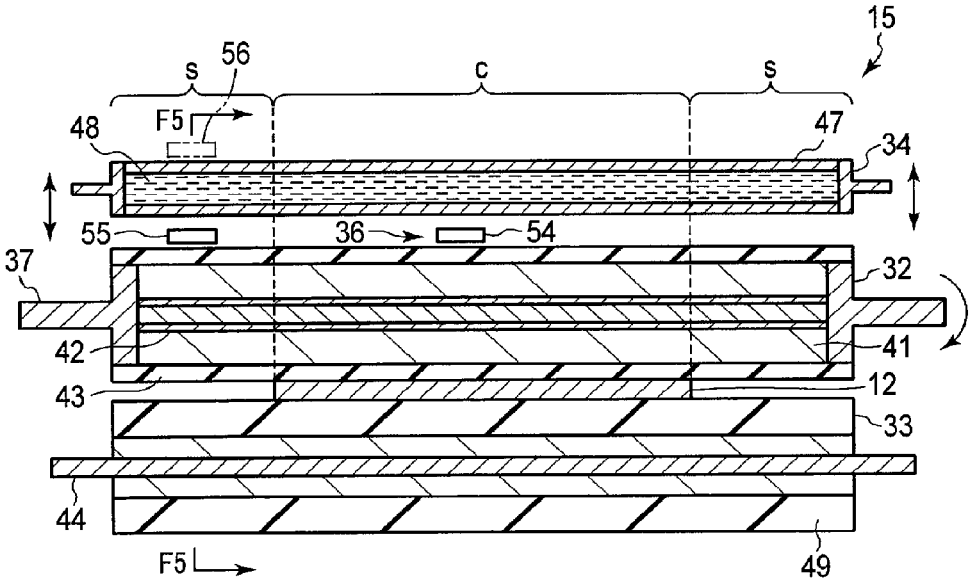
FIG. 6 is a cross-sectional view along a lateral direction of the fixing unit of the image forming apparatus illustrated in FIG. 5.
Figure 7:
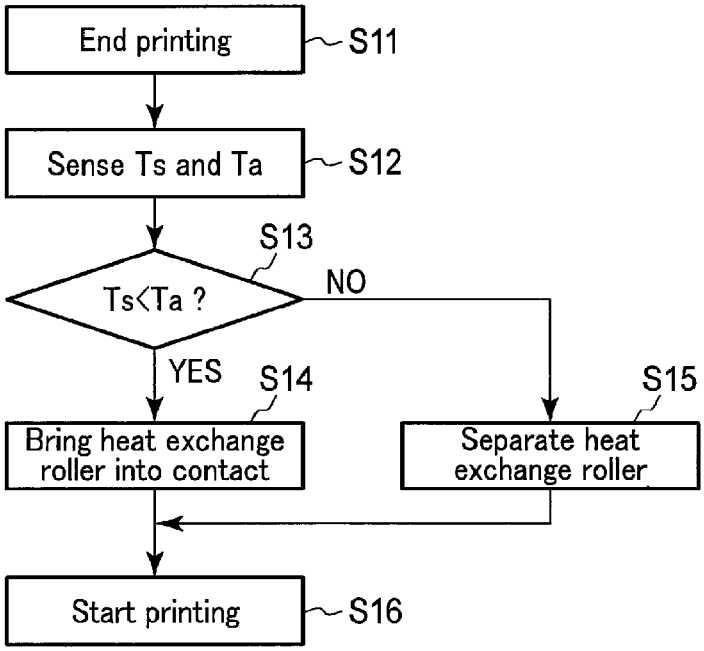
FIG. 7 is a flowchart illustrating an image forming method using the image forming apparatus according to the second embodiment.

The following is an explanation of a second embodiment of the image forming apparatus with reference to FIG. 5 to FIG. 7. The image forming apparatus 11 according to the second embodiment is different from the first embodiment in that the sensor 36 includes a third sensing unit 56, and the heat exchange roller 34 is brought into contact with the fixing roller 32 when printing is stopped, but the other parts thereof are the same as the first embodiment. For this reason, mainly the parts different from the first embodiment will be explained hereinafter, and illustrations or explanations of the parts common to the first embodiment will be omitted.

As illustrated in FIG. 5 and FIG. 6, the sensor 36 includes a first sensing unit 54 provided to correspond to the contact region C in the fixing roller 32, a second sensing unit 55 provided to correspond to the non-contact region S, and the third sensing unit 56 that senses the temperature of the heat exchange roller 34.

The third sensing unit 56 is capable of sensing the temperature of the heat exchange roller 34 at a position corresponding to the non-contact region S of the fixing roller 32, that is, the temperature (third temperature Ta) at the position of the end portion of the heat exchange roller 34. The third sensing unit 56 may be, for example, a thermocouple that directly contacts the heat exchange roller 34 to measure a temperature thereof, a resistance change thermistor of a non-contact type, a radiation temperature sensor, or may be a temperature sensor of other types.

The following is an explanation of an image forming method using the image forming apparatus 11 according to the present embodiment, with reference to FIG. 7.

In the state where a printing operation is finished (Step S11), the second sensing unit 55 senses the second temperature Ts of the non-contact region of the fixing roller 32, and the third sensing unit 56 senses the third temperature Ta of the end portion of the heat exchange roller corresponding to the non-contact region S (Step S12). Thereafter, the controller 21 determines whether the second temperature Ts is lower than the third temperature Ta (Step S13). When the second temperature Ts is lower than the third temperature Ta, the controller 21 makes the heat exchange roller 34 abut against the fixing roller 32 (Step S14). This operation enables the heat accumulated in the heat exchange roller 34 to be discharged to the fixing roller 32 to increase the temperature of the fixing roller 32. This improves the heat retaining property of the fixing roller 32. By contrast, when the second temperature Ts is higher than the third temperature Ta, the controller 21 separates the heat exchange roller 34 from the fixing roller 32 (Step S15). This operation prevents the heat of the fixing roller 32 from being discharged to the heat exchange roller 34.

These operations are repeated until the next operation start instruction is issued (Step S16). The above operating method enables both making the temperature of the fixing roller 32 uniform, and power savings in the fixing unit 15.

According to the present embodiment, the sensor 36 includes the third sensing unit 56 that senses the temperature of the heat exchange roller 34, and the controller 21 controls the driving unit 35 to make the heat exchange roller 34 abut against the fixing roller 32 when the third temperature Ta, sensed by the third sensing unit 56 when printing is stopped, is higher than the second temperature Ts.

Generally, improvement in the heat retaining property of the fixing roller 32 enables a reduction in power consumption necessary for heating the fixing roller 32 in the next printing.

The above structure enables the heat accumulated in the heat exchange roller 34 to discharge to the fixing roller 32 when printing is stopped to increase the temperature of the fixing roller 32, and to improve the heat retaining property of the fixing roller 32. In addition, by discharging the heat accumulated in the heat exchange roller 34 to the fixing roller 32 when printing is stopped, the heat absorption capability of the heat exchange roller 34 can be kept high when executing the next printing.

[Third Embodiment]

Figure 8:
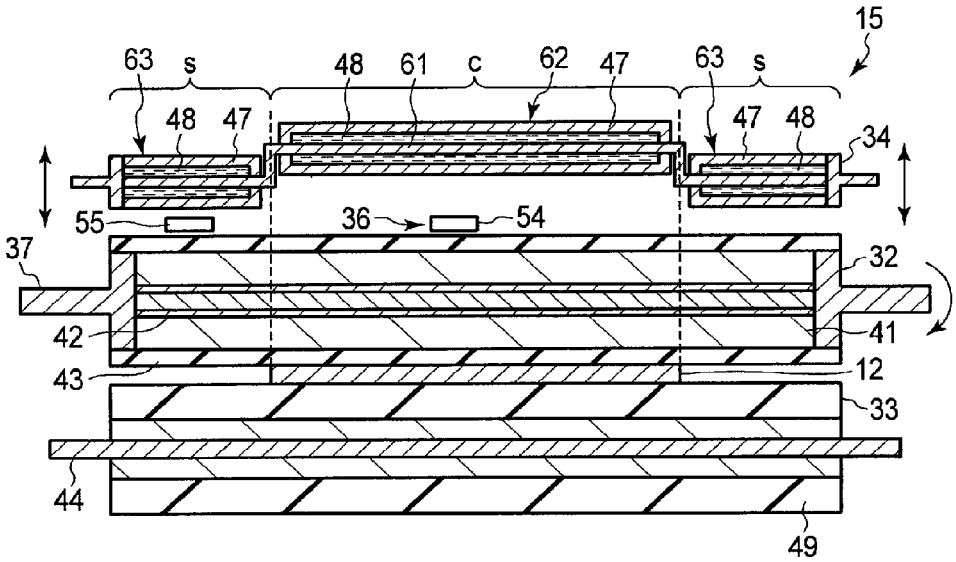
FIG. 8 is an enlarged cross-sectional view of a fixing unit of an image forming apparatus according to a third embodiment, illustrating a state directly before second units of a heat exchange roller abut against non-contact regions of a fixing roller.
Figure 9:
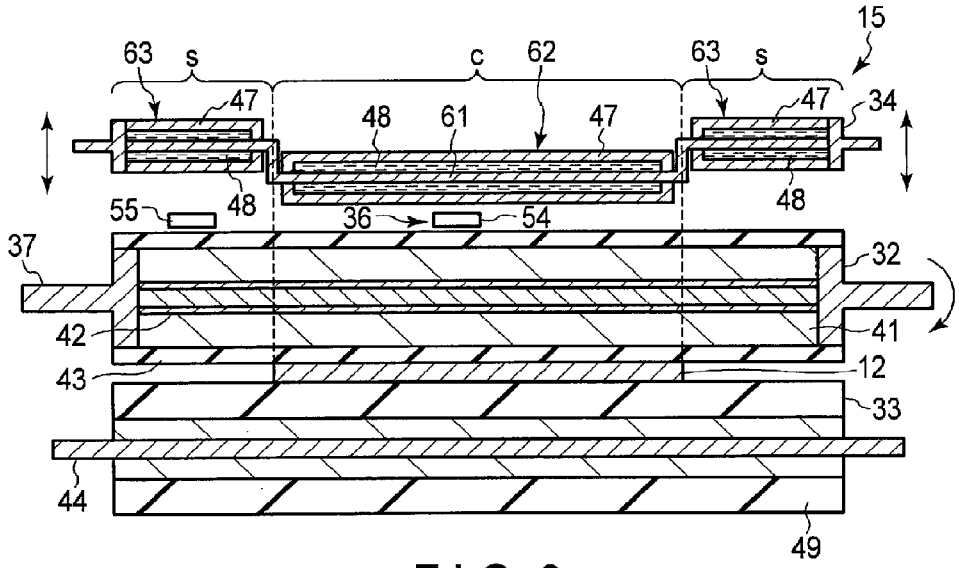
FIG. 9 is an enlarged cross-sectional view of the fixing unit of the image forming apparatus according to the third embodiment, illustrating a state directly before a first unit of the heat exchange roller abuts against a contact region of the fixing roller.
Figure 10:
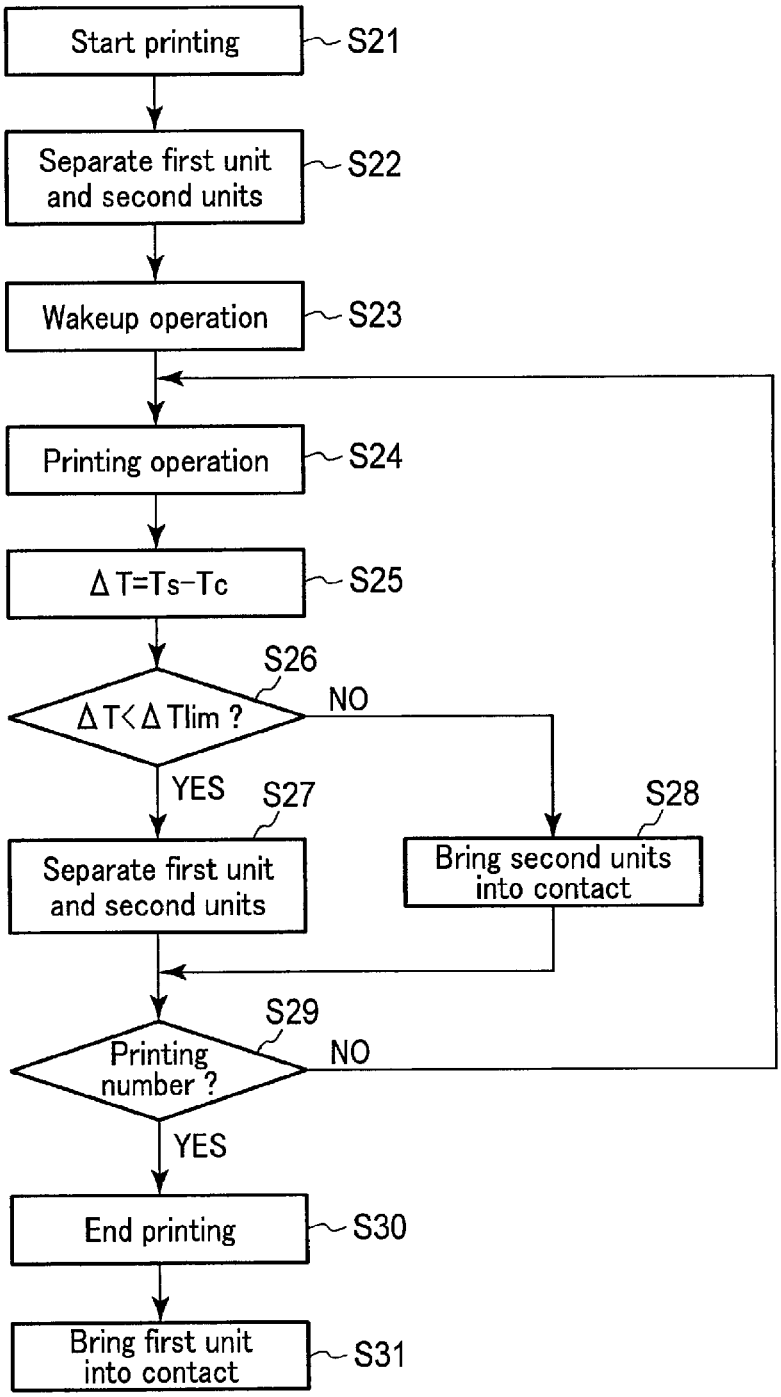
FIG. 10 is a flowchart illustrating an image forming method using the image forming apparatus according to the third embodiment.

The following is an explanation of a third embodiment of the image forming apparatus 11 with reference to FIG. 8 to FIG. 10. The image forming apparatus 11 of the third embodiment is different from the first embodiment in that the shape of the heat exchange roller 34 is different, but the other parts thereof are the same as the first embodiment. For this reason, mainly the parts different from the first embodiment will be explained hereinafter, and illustrations or explanations of the parts common to the first embodiment will be omitted.

The fixing unit 15 is capable of thermally fixing on the printing object 12 the toner image that has been transferred onto the printing object 12 by the transfer unit 14. As illustrated in FIG. 8, the fixing unit 15 includes a fixing roller 32 (heating roller), a fixing opposing roller 33, a heat exchange roller 34 (heat absorption roller), a driving unit 35, and a sensor 36. The fixing roller 32, the fixing opposing roller 33, the driving unit 35, and the sensor 36 have the same structures as those in the first embodiment.

The heat exchange roller 34 includes a plurality of metal cylindrical portions 47, a crank shaft portion 61 (shaft portion) that extends to run through the cylindrical portions 47, and heat storage materials 48 contained inside the respective cylindrical portions 47.

In the present embodiment, the cylindrical portions 47 are formed of three units, that is, one first unit 62 located in the center, and a pair of second units 63 located on both sides of the first unit 62. The cylindrical portions 47 may be formed of three or more units. The first unit 62 can abut against the contact region C of the fixing roller 32. The second units 63 can abut against the non-contact regions S of the fixing roller 32.

Each of the cylindrical portions 47 (first unit 62, and second units 63) is formed of aluminum alloy. Each of the cylindrical portions 47 is rotatable around the crank shaft portion 61. The heat storage materials contained inside the respective cylindrical portions 47 are the same as that in the first embodiment.

The first unit 62 is provided to be eccentric with respect to the second unit 63 due to the crank-like structure of the crank shaft unit 61. For this reason, as illustrated in FIG. 8, when the second units 63 of the heat exchange roller 34 corresponding to the non-contact regions S abut against the fixing roller 32, the first unit 62 of the heat exchange roller 34 corresponding to the contact region C is separated from the fixing roller 32 (FIG. 8 illustrates the state directly before the second units 63 abut against the fixing roller 32). In contrast, as illustrated in FIG. 9, when the second units 63 of the heat exchange roller 34 corresponding to the non-contact regions S are separated from the fixing roller 32, the first unit 62 of the heat exchange roller 34 corresponding to the contact region C abuts against the fixing roller 32 (FIG. 9 illustrates the state directly before the first unit 62 abuts against the fixing roller 32).

The crank shaft portion 61 is formed of a material (metal material) having higher thermal conductivity than that of the heat storage materials 48, and thermally connects the first unit 62 contacting the contact region C with the second units 63 contacting the non-contact regions S. Therefore, the first unit 62 is able to transmit (exchange) heat to the second units 63 through the crank shaft portion 61. A heat pipe may be disposed in the crank shaft portion 61, or the crank shaft portion 61 itself may be formed of a heat pipe. Disposing a heat pipe in the crank shaft portion 61 improves the thermal conductivity performance between the first unit 62 and the second units 63.

The following is an explanation of an image forming method using the image forming apparatus according to the present embodiment, with reference to FIG. 8 to FIG. 10.

By a user's operation of the operating unit 17, the controller 21 of the image forming apparatus 11 receives a printing start instruction through line S1 (Step S21). In accordance with the instruction, the controller 21 separates the first unit 62 and the second units 63 of the heat exchange roller 34 from the fixing roller 32 (Step S22), and executes a wakeup operation (Step S23). By this operation, the controller 21 supplies a temperature control instruction to the fixing unit 15, and supplies power to the heater 42 of the fixing roller 32 to heat the fixing roller 32 and the fixing opposing roller 33 contacting the roller to a predetermined temperature, in other words, to a temperature necessary for fixing the toner.

After the rollers are heated to a suitable temperature in this manner, the controller 21 drives the transfer unit 14 through line S3 to start a printing operation (Step S24). The printing object 12, which has been carried from the paper feeding unit 13 to the transfer unit 14 and onto which a toner image has been transferred, is conveyed to the fixing unit 15. The printing object 12 and the toner of the toner image transferred thereon are heated by the fixing roller 32, and the toner image is fixed on the printing object 12. The printing operation is continued until the number of printed items reaches the printing number designated by the user. During the printing operation, the first sensing unit 54 and the second sensing unit 55 of the sensor 36 respectively senses the first temperature Tc of the contact region C of the fixing roller 32, and the second temperature Ts of the non-contact region S (Step S25). Thereafter, the value of the difference "$\Delta T = Ts - Tc$" between the second temperature Ts and the first temperature Tc is compared with a predetermined upper limit temperature difference value $\Delta Tlim$ (Step S26). When $\Delta T$ is smaller than $\Delta Tlim$, the controller 21 operates the driving unit 35 to separate both the first unit 62 of the heat exchange roller 34 corresponding to the contact region C, and the second units 63 of the heat exchange roller 34 corresponding to the non-contact regions S from the fixing roller 32 (Step S27). By contrast, when $\Delta T$ exceeds $\Delta Tlim$, as illustrated in FIG. 8, the controller 21 operates the driving unit 35 to make the second units 63 of the heat exchange roller 34 corresponding to the non-contact regions S abut against the fixing roller 32 (Step S28). The abutting decreases the temperature of the non-contact regions S of the fixing roller 32 on a priority basis by latent heat melting of the phase change materials included in the second units 63.

The separating and abutting operations on the heat exchange roller 34 in accordance with the temperature difference $\Delta T$ are repeated until the number of printed items reaches a set printing number (Step S29). When the number of printed items reaches the set printing number, the controller 21 ends the printing operation (Step S30). When the printing operation is ended, as illustrated in FIG. 9, the controller 21 operates the driving unit 35 to make the first unit 62 of the heat exchange roller 34 corresponding to the contact region C abut against the fixing roller 32 (Step S31). When this occurs the heat exchange roller 34 is made to abut against the fixing roller 32, after being changed from the state illustrated in FIG. 8 to a state where the crank shaft portion 61 is rotated by, for example, 180° around the central axis thereof. This operation enables heat accumulated in the second units 63 of the heat exchange roller 34 to be conducted to the fixing roller 32 through the crank shaft portion 61 and the first unit 62.

According to the third embodiment, the heat exchange roller 34 includes the crank-shaped shaft portion, the first unit 62 that is rotatable with respect to the shaft portion and provided to correspond to the center portion of the fixing roller 32 and contain the storage material 48. The second units that are rotatable with respect to the shaft portion are provided to be eccentric with respect to the first unit 62, and correspond to the end portions of the fixing roller and contain the respective storage materials. The second units abut against the end portions of the fixing roller in the printing operation, and the first unit abuts against the center portion of the fixing roller when printing is stopped.

Ordinarily, when a printing operation is continued, heat is radiated from the fixing roller 32 to the printing object 12 in the contact region C of the fixing unit 15 that contacts the printing object 12, while no heat is radiated in the non-contact regions S. For this reason, the temperature Ts of the fixing roller 32 in the non-contact region S increases, and the heat may damage peripheral members, such as the opposing roller. When the next printing object 12 is supplied to the region that was the non-contact region S, toner on the printing object 12 may stick to the fixing roller 32 due to high temperature, and thereby the printing quality may deteriorate.

The above structure enables sensing of the temperature difference ΔT between the contact region C and the non-contact regions S in the fixing roller 32, and the second units 63 of the heat exchange roller 34 are made to abut against the non-contact regions S of the fixing roller 32 when the temperature difference ΔT is higher than the upper limit value. The abutting decreases the temperature of the non-contact regions S of the fixing roller 32 on a priority basis by absorbing heat of the fixing roller 32 by latent heat melting of the heat storage materials 48 included in the second units 63. After the printing operation has ended, the first unit 62 of the heat exchange roller 34 is made to abut against the contact region C of the fixing roller 32, to conduct the heat accumulated in the second units 63 to the fixing roller 32 through the crank shaft portion 61 and the first unit 62. This operation enhances the heat retaining property in the contact region C of the fixing roller 32, and reduces the power consumption necessary for heating the fixing roller 32 in the next printing. In addition, because the heat of the heat exchange roller 34 can be efficiently discharged through the contact region C having a relatively low temperature in the fixing roller 32, the above structure sufficiently decreases the temperature of the second units 63, and maintains the heat absorption capability of the second units 63 in the next operation.

In the present embodiment, the heat storage material 48 (phase change material) contained in the first unit 62 is formed of the same material as that of the heat storage materials 48 (phase change material) contained in the second units 63, but the heat storage material 48 contained in the first unit 62 may be formed of a material different from that of the heat storage materials 48 contained in the second units 63. Specifically, the phase change temperature of the heat storage materials 48 contained in the second units 63 may be set higher than the heat storage material 48 contained in the first unit 62. This setting enables latent heat collected by the heat storage materials 48 contained in the second units 63 to be conveyed to the heat storage material 48 contained in the first unit 62, and long-term storage of the heat therein as latent heat while operations are stopped.

The present invention is not limited to the above embodiments, and may be properly modified within a range without departing from the gist of the invention. Specifically, the image forming apparatus is not limited to those illustrated in the first embodiment to the third embodiments described above; an image forming apparatus may be formed by combining constituent elements illustrated in the first embodiment to the third embodiment.

Some embodiments of the present invention have been explained above, but these embodiments are presented as examples, and are not aimed at restricting the scope of the invention. These embodiments may be carried out in other various forms, and various omissions, replacements, and changes thereof may be made within a range not departing from the gist of the invention. These embodiments and modifications thereof are included in the scope and the gist of the invention, and included in the inventions described in the claims and a range equivalent to them.

The following is an additional description of a structure indicating other features of the present invention.

The image forming apparatus, wherein the heat exchange roller includes:

a crank-shaped shaft portion;

a first unit rotatable with respect to the shaft portion, the first unit provided to correspond to the center portion of the fixing roller and containing the heat storage material; and a second unit rotatable with respect to the shaft portion, the second unit provided to be eccentric with respect to the first unit and to correspond to the end portion of the fixing roller, and containing the heat storage material, the second unit abuts against the end portion of the fixing roller during printing operation, and the first unit abuts against the center portion of the fixing roller when printing is stopped.

EXPLANATIONS OF REFERENCE SIGNS

11 . . . Image forming apparatus, 12 . . . printing object, 21 . . . controller, 32 . . . Fixing roller, 33 . . . Fixing opposing roller, 34 . . . heat exchange roller, 35 . . . driving unit, 36 . . . sensor, 48 . . . heat storage material, 54 . . . first sensing unit, 55 . . . second sensing unit, 56 . . . third sensing unit.

What is claimed is:

1. An image forming apparatus comprising:

a fixing roller including a heat generation source, supplying heat to a printing object, and fixing toner on the printing object;

an opposing roller opposed to the fixing roller to hold the printing object between the opposing roller and the fixing roller;

a heat exchange roller containing a heat storage material capable of changing in phase between liquid and solid;

a sensor capable of sensing a temperature of the fixing roller, the sensor including a first sensing unit sensing a temperature of an end portion of the fixing roller in an axial direction and a second sensing unit sensing a temperature of the heat exchange roller;

a driving unit causing the heat exchange roller to abut against the fixing roller and separating the heat exchange roller from the fixing roller, in accordance with the temperature of the fixing roller sensed by the sensor; and a controller which controls the driving unit to make the heat exchange roller abut against the fixing roller, when a second temperature sensed by the second sensing unit is higher than a first temperature sensed by the first sensing unit while heating of the fixing roller is stopped.

2. The image forming apparatus according to claim 1, wherein the heat storage material has a phase change temperature higher than a melting point of the toner.

3. The image forming apparatus according to claim 1, wherein the heat storage material is one of erythritol and mannitol.

* * * * *